United States Patent [19]

Downey et al.

[11] Patent Number: 4,508,044

[45] Date of Patent: Apr. 2, 1985

[54] REBUILT PILLOW AND METHOD OF MANUFACTURING THE SAME

[76] Inventors: Robert E. Downey; Claudine K. Downey, both of 1902 E. Fir St., Mt. Vernon, Wash.

[21] Appl. No.: 504,068

[22] Filed: Jun. 14, 1983

[51] Int. Cl.[3] ..... D05B 97/00

[52] U.S. Cl. ..... 112/262.2; 5/434; 5/490; 112/420; 112/441

[58] Field of Search ..... 112/262.2, 262.1, 420, 112/440, 441; 5/434, 435, 436, 442, 490; 428/74, 76

[56] References Cited

U.S. PATENT DOCUMENTS

| | | | |
|---|---|---|---|
| 765,519 | 7/1904 | Sperry | 5/442 |
| 2,234,506 | 3/1941 | Sistig | 5/490 X |
| 2,612,646 | 10/1952 | Sussman | 112/262.2 X |
| 2,805,428 | 9/1957 | Buchman | 5/442 |
| 2,956,291 | 10/1960 | Hauptman | 5/434 |
| 3,109,474 | 11/1963 | Levi | 112/262.2 X |
| 3,273,524 | 9/1966 | Koltun | 112/262.2 |
| 3,411,164 | 11/1968 | Sumergrade | 5/434 X |
| 3,543,313 | 12/1970 | Schweigert | 5/434 |
| 3,955,515 | 5/1976 | Elsas | 112/262.2 X |
| 4,021,871 | 5/1977 | Wortman | 5/434 |

*Primary Examiner*—H. Hampton Hunter

*Attorney, Agent, or Firm*—Hughes, Barnard & Cassidy

[57] ABSTRACT

An existing pillow which has a tick enclosing a stuffing that has deteriorated is inserted into an envelope. The envelope is made of a yielding foam material having a wall thickness sufficient to mask irregularities in the stuffing of the existing pillow. The entire pillow, including the tick and the enclosed stuffing is inserted into the envelope, and the envelope is then sewn shut. The envelope with the existing pillow is then placed into a second tick to form the rebuilt pillow.

17 Claims, 6 Drawing Figures

FIG. 1
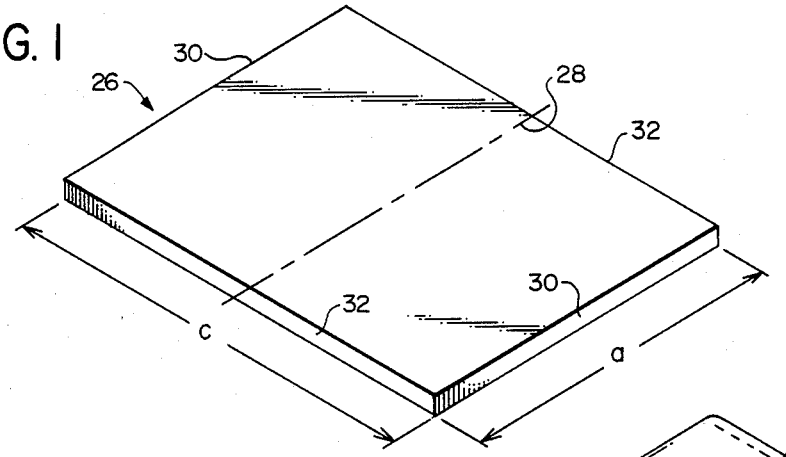
FIG. 2
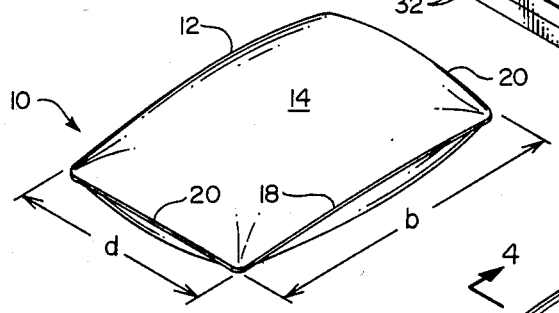
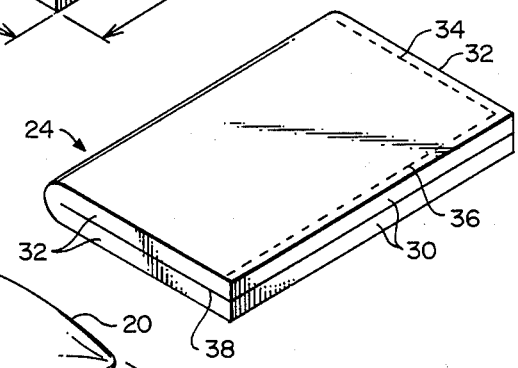
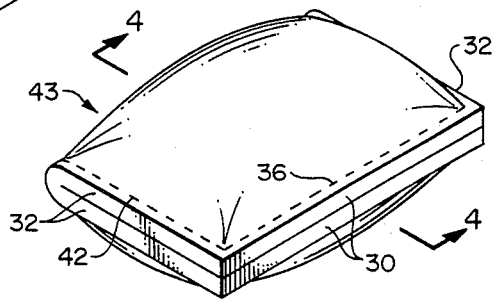
FIG. 3
FIG. 4
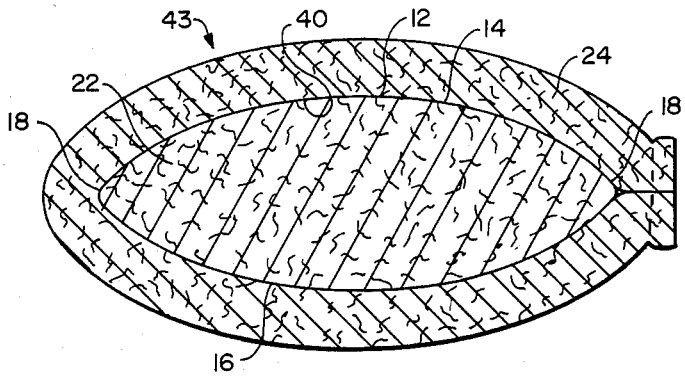

REBUILT PILLOW AND METHOD OF MANUFACTURING THE SAME

TECHNICAL FIELD

The present invention relates to a method of making a rebuilt pillow, such as a bed pillow, and to the pillow which is made from said method.

BACKGROUND ART

In operating a motel or hotel, while pillows are not the most expensive item in the furnishings, the initial investment in pillows is not insignificant, and the upkeep and replacement of these is a recurring expense item. These pillows must be washed or otherwise cleaned in some manner with a much greater frequency than would be the case if they were used, for example, in a person's home. The repeated cleaning and washing has a tendency to cause the interior stuffing of the pillow to deteriorate, so that the pillow becomes lumpy and thus uncomfortable, or deteriorates in some other fashion. At this point, the pillow must be discarded and replaced with another pillow, or the pillow must be rehabilitated in some manner.

One possible approach to rehabilitating the pillow is to open the tick of the pillow along one seam, remove the old stuffing, and replace the stuffing of the pillow. This has not proven to be totally satisfactory. First, the tick of the pillow has itself experienced some wear, so that the rehabilitated pillow still has the overall appearance of a worn object. Also, the wear on the tick may be sufficient so that continued use of the old tick as the outer casing of the rebuilt pillow may cause it to wear out before the new stuffing has deteriorated so as to need replacement. Thus, there would be the necessity of a second rehabilitating process where the still usable stuffing is placed within a new tick.

As a result of these problems, many motels and hotels have adopted the practice of simply discarding the pillows which are no longer satisfactory and purchasing new pillows. This, of course, means that over a period of time the total inventory of pillows in the establishment must be replaced.

A search of the patent literature has revealed some U.S. patents which relate generally to pillows. While it is believed that these do not relate directly to the problems discussed above, these are cited to insure that the applicatant is making a full disclosure of all prior art of possible relevance.

U.S. Pat. No. 765,519, Sperry, shows a pillow having inner and outer compartments. The outer casing is divided by ligaments into a plurality of exterior compartments which collectively surround the inner compartment.

U.S. Pat. No. 2,805,428, Buchman, shows a pillow made up of several enclosed sections of filler material.

U.S. Pat. No. 2,956,291, Hauptman, shows a pillow formed of foamed sheets which are joined together to contain down or feathers.

U.S. Pat. No. 3,543,313, Schweigert, discloses a pillow which has an intersection of a lower quality filler, and an outer section of higher quality filler. The inner pillow has strap-like connections at its four corners which join to the outer casing.

U.S. Pat. No. 4,021,871, Wartman, shows a cushion that is formed with an outer foam structure, which is stuffed with a fibrous material.

Finally, U.S. Pat. No. 4,185,643, Daniello, discloses a carrying bag with a foam insert. This foam insert can be used as a cushion for a chair.

In view of the foregoing, it is an object of the present invention to provide a method of making a rebuilt pillow, which method quite advantageously uses an existing pillow which is of less than adequate quality. It is a further object to provide such a rebuilt pillow itself.

It is an additional object to provide such a method which can be effectively utilized at the location of, or in close cooperation with, existing hotels and motels with a minimum disruption of, or interference with, the operating routine of such hotels and motels.

SUMMARY OF THE INVENTION

In the method of the present invention, there is first provided an existing pillow comprising a tick and a stuffing enclosed within the tick. The stuffing has sufficient bulk to occupy a substantial portion of an interior area of the tick, but which provides less than adequate cushioning support.

There is also provided an envelope having an overall configuration and overall dimensions corresponding to the existing pillow. The envelope defines a cavity to receive the existing pillow, and the envelope is made of a yielding, cushioning material that has a wall thickness sufficient to mask irregularities of the stuffing of the existing pillow.

The existing pillow is inserted into the cavity of the envelope. Then the envelope with the existing pillow therein is inserted into a second tick having an opening. The opening of the second tick is closed to form the rebuilt pillow.

Desirably, the envelope has a wall thickness of at least about 1". In the preferred form, the envelope has a wall thickness between about 1" and 1.5".

The envelope is desirably made by providing a generally rectangular sheet of a cushioning material having a first width dimension corresponding to a first linear dimension along a first edge of the existing pillow, and a length dimension corresponding to a circumferential dimension along a circumference of said existing pillow. This circumference lies in a plane generally perpendicular to the length dimension of the existing pillow. Then the sheet is folded in half and sewn along two seams to leave an opening. After this, the existing pillow can be inserted into the cavity of the envelope. Then, the opening of the envelope is sewn shut to have the envelope completely enclose the existing pillow.

Preferrably, the envelope has an interior circumference dimension moderately less than the circumference dimension of the existing pillow around a lengthwise dimension of said existing pillow, which circumference is taken with the pillow being in an uncompressed condition. Thus, the envelope is stretched around the pillow to press inwardly against the pillow, which then becomes compressed moderately when it is inserted into the envelope.

The pillow made according to the process of the present invention comprises the existing pillow, surrounded by the envelope, with the envelope being enclosed in the second tick.

To utilize the process for rebuilding pillows for an establishment having a plurality of existing pillows, there is provided a plurality of said envelopes, closed along two seams, and also a plurality of second ticks. The existing pillows are collected, after which the existing pillows are inserted into the cavities of related envelopes. Then the various envelopes are inserted into related second ticks, as described above.

Other features of the present invention will become apparent from the following detailed description.

FIGURES

FIG. 1 is an isometric view of a sheet of foam material which is used to form an envelope which is to be incorporated into the process and product of the present invention;

FIG. 2 is an isometric view showing the foam sheet of FIG. 1 formed into an envelope, and also illustrating an existing pillow which is to be inserted into the envelope;

FIG. 3 is an isometric view of the envelope with the existing pillow being contained therein;

FIG. 4 is a sectional view taken along line 4—4 of FIG. 3; and

DETAILED DESCRIPTION

Figure 5:
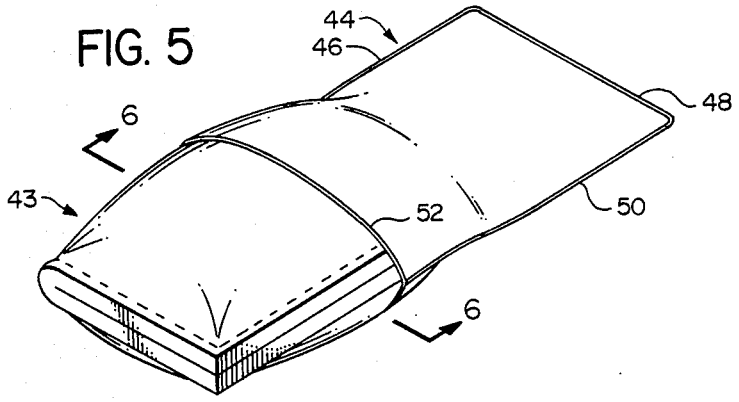
FIG. 5 is an isometric view, similar to FIG. 2, showing the intermediate product of FIG. 3 being inserted into a new tick.
Figure 6:
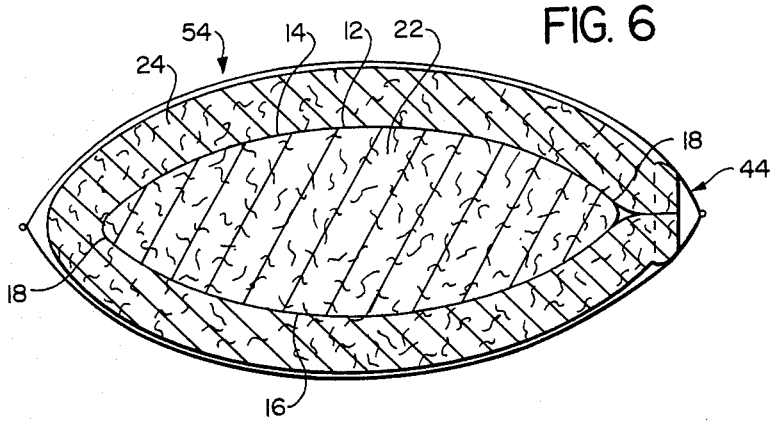
FIG. 6 is a sectional view similar to that of FIG. 4, illustrating the components shown in FIG. 4 encased in an outer second tick of FIG. 5 so as to form the rebuilt pillow.

A typical bed pillow which is commonly used in motels and hotels comprises a casing or tick which completely encloses the interior or stuffing of the pillow. This tick is generally made of a durable sheet of cloth which, in the final configuration of the pillow, can be considered as being made up of two rectangular sections sewn together along at least three seams at the edge of the two sections so as to totally enclose the stuffing.

The stuffing is generally a fiber or foam-like material, or can be feathers or down contained in the tick. However, regardless of the exact composition of the stuffing, it generally happens that after a period of use of the pillow, with repeated washings or other cleanings, the structure of the stuffing deteriorates to some extent. The structure can break down to some extent, and/or possibly form into moderately hard lumps. In any event, when the stuffing does deteriorate in some manner, it does not provide the proper uniform cushion that is generally expected of a bed pillow. As indicated earlier, it is not uncommon for a hotel or motel to discard the entire pillow and replace it with a new one when such deterioration occurs.

As indicated earlier, the present invention is designed to utilize an existing pillow which has deteriorated to the degree where the stuffing does not provide adequate comfort for the user. Such a pillow is indicated at 10 in FIG. 2. This pillow 10 has a tick or casing 12 of an overall rectangular, configuration. The tick 12 has a top surface 14, a bottom surface 16, two side edge portions 18, and two end edge portions 20. The stuffing of the existing pillow is indicated at 22, and this is shown in section in FIG. 4.

The initial step in the method of the present invention is to provide an envelope 24 which has an overall configuration and dimensions corresponding to the existing pillow 10. This envelope is made of a yielding or cushioning material, such as a fibrous batt of polyester or some other material, or possibly a foam-like material. As shown herein, the material is initially provided as a rectangular sheet 26, as shown in FIG. 1. This sheet 26 has a first edge dimension, indicated at "a", nearly the same as or slightly larger than a lengthwise dimension, indicated at "b", of the existing pillow 10. The sheet 26 has a second edge dimension, indicated at "c" in FIG. 1, which is nearly the same as or slightly smaller than twice the width dimension, indicated at "d" in FIG. 2, of the pillow 10.

The envelope 24 is provided by folding the sheet 26 at a center line 28 perpendicular to the dimension "c" so that the two edge portions 30 along the "a" dimension become adjacent one another, and the two halves of each of the other edge portions 32 are adjacent one another. Then the sheet 26 is sewn along one set of halves of the edge portion 32 to form the seam at 34. Also, the two edge portions 30 are sewn one to another to form the seam 36. This completes the formation of the envelope 24, which has a single open edge portion at 38, this being the location where the two halves of the other of the edge portions 32 are adjacent one another.

The next step is to spread the envelope edge portions at 38 apart and insert the existing pillow 10 into the interior of the envelope 24, this interior being indicated at 40 in FIG. 4. With the existing pillow 10 located totally within the envelope interior 40, the edge portions at 38 are sewn together in a conventional manner to form-a seam 42 which causes the pillow 10 to be entirely enclosed in the envelope 24. At this stage of the process, as can be seen in FIG. 4, there is an intermediate product 43 which comprises the existing pillow 10 (including both the tick 12 and the stuffing 22) fitting snugly within the confines of the envelope 24. Generally, the dimensions of the sheet 26 would be selected so that the envelope 24 becomes stretched moderately as the existing pillow 10 is inserted into the envelope 24.

For example, with an existing pillow having a length dimension at "a" of 25 inches and a width dimension at "d" of 18 inches (measured along the edges of the existing pillow), the "a" and "c" dimensions of the sheet 26 would be approximately 24 inches to 25 inches and 18 inches to 18.5 inches, respectively. Normally the seams are sewn at a location about a half inch inwardly from the edge portions of the sheet 26. Thus, for the existing pillow 10 with the dimensions noted above, the circumference around the width of the pillow (i.e. in a plane perpendicular to the lengthwise dimension "b"), would be about twice the width dimension (indicated at "d"). However, with the existing pillow 10 inserted into the envelope 24, this circumference of the existing pillow 10 would be reduced just slightly as the moderate compressive force is exerted on the pillow.

This rather moderate compressing of the existing pillow 10 has the effect of enhancing the stability or firmness of the structural character of the stuffing 14 of the existing pillow 10. Also, it has been found that this moderate compressing of the existing pillow 10 diminishes the effect of lumpiness or irregularities of the stuffing 12, so as to cooperate uniquely with the cushioning provided by the wall of the envelope 24 which further masks any lumpiness, irregularities, or undesired hardness of the existing pillow 10. Generally, the wall thickness of the envelope 24 would be at least as great as approxmately 1 inch, or possibly as great as 1.5 inch.

Subsequent to the formation of the intermediate product, shown in FIGS. 3 and 4, the envelope 24 with the existing pillow 10 contained therein is inserted into a second new tick 44, in the manner shown in FIG. 5. This can be accomplished in a conventional manner, such as initially providing the new tick 44 which is closed around three seams 46, 48, and 50, with one of the seams at 52 being open. After the envelope 24 with the existing pillow 10 therein is inserted into the tick 44, the open seam 52 is then sewn to make a totally enclosed tick 44.

The end product is a rebuilt pillow indicated at 54 and shown in transverse section. It can be seen that this rebuilt pillow 54 comprises the existing pillow 10 in its entirety, including the stuffing 22 and the tick 12. Further, there is the envelope 24 and the second new tick 44. This rebuilt pillow 54 can be used in the same manner as a conventional high quality bed pillow. The old stuffing 22 is used quite advantageously, in that, by being enclosed and moderately compressed in the envelope 24, its structure has more firmness than it had previously in its somewhat deteriorated condition. Further, the tick 12 of the existing pillow 10 is concealed in a manner so that it is not subjected to direct frictional engagement with people or other objects which would tend to wear it out at a faster rate. The envelope 24 provides a cushioning layer or wall which gives the proper uniform cushioning support of a bed pillow, while masking the deficiencies and/or irregularities of the existing pillow 10. Finally, the new tick 44 gives the rebuilt pillow 54 the texture and appearance of a new pillow.

A unique advantage of the present invention is that the process can be practiced in a manner to be very compatible with the existing operations of many motels and hotels. Normally, the cleaning of hotel and motel rooms begins in the morning as people are checking out of their rooms. As the bed pillows of that room have the pillow cases removed therefrom, these pillows 10 can be collected at a central location, possibly in an empty room of the motel or hotel. Normally, the envelopes 24 would be presewn so as to be in the configuration shown in FIG. 2, and the new ticks 44 would be sewn or closed about three seams, as shown in FIG. 5.

Then each existing pillow 10 is inserted into a related envelope 24, which is sewn shut to form the intermediate product indicated at 43. Next, the intermediate product is placed in the new tick 44 and the one open seam 52 is sewn. As the rebuilt pillows 54 are completed, these can be delivered to the people who are preparing the rooms for the next set of guests.

As an alternate procedure, the existing pillows 10 which are to serve as components for the rebuilt pillows 54 can be collected from a hotel or motel and moved to a location somewhat removed from the motel or hotel. The same operation can be performed at the more remote location, with the rebuilt pillows 54 then being returned to the motel or hotel on the following day or shortly thereafter.

The above description is intended to describe the preferred form of the present invention, and it is obvious that variations could be made in this process without departing from the teachings of the present invention.

We claim:

1. A method of making a rebuilt pillow, said method comprising:

(a) providing an existing pillow comprising a tick and a stuffing enclosed within said tick, said stuffing having sufficient bulk to occupy a substantial portion of an interior area of said tick, but which provides less than adequate cushioning support;

(b) providing an envelope having an overall configuration and overall dimensions corresponding to said existing pillow, said envelope defining a cavity to receive said existing pillow, said envelope being made of a yielding, cushioning material having a wall thickness sufficient to mask irregularities in the stuffing of the existing pillow;

(c) inserting the existing pillow into the cavity of said envelope;

(d) providing a second tick having an opening and inserting into the second tick the envelope with the existing pillow therein;

(e) closing the opening of the second tick to form said rebuilt pillow.

2. The method as recited in claim 1, wherein said envelope has a wall thickness of at least about one inch.

3. The method as recited in claim 2, wherein said envelope has a wall thickness between about one inch and one and a-half inch.

4. The method as recited in claim 1, wherein said envelope is provided by first providing a generally rectangular sheet of a cushioning material having a first width dimension corresponding to a first linear dimension along a first edge of said existing pillow, and a length dimension corresponding to a circumferential dimension along a circumference of said existing pillow, which circumference lies in a plane generally perpendicular to said length dimension of the existing pillow, then folding the sheet in half and sewing it along two seams to leave an opening, after which the existing pillow can be inserted into the cavity of the envelope.

5. The method as recited in claim 4, wherein after the existing pillow is inserted into the cavity of the envelope, closing an opening of said envelope to completely enclose said existing pillow.

6. The method as recited in claim 1, wherein said existing pillow has a circumference dimension along a circumference line positioned in a plane perpendicular to a lengthwise dimension of said existing pillow, with said existing pillow being in an uncompressed condition, and said envelope has an interior circumference dimension moderately less than the circumference dimension of the existing pillow, whereby said existing pillow becomes compressed moderately when it is inserted into the envelope.

7. The method as recited in claim 1, wherein:

(a) said envelope has a wall thickness between about one inch and one and a-half inch;

(b) said envelope is provided by first providing a generally rectangular sheet of cushioning material having a first width dimension corresponding to a first linear dimension along a first edge of said existing pillow, and a length dimension corresponding to a circumferential dimension along a circumference of said existing pillow, which circumference lies in a plane generally perpendicular to said length dimension of the existing pillow, then folding the sheet in half and sewing it along two seams to leave an opening, after which the existing pillow can be inserted into the cavity of the envelope;

(c) said existing pillow has a circumference dimension along a circumference line positioned in a plane perpendicular to a lengthwise dimension of said existing pillow, with said existing pillow being in an uncompressed condition, and said envelope has an interior circumference dimension moderately less than the circumference dimension of the existing pillow, whereby said existing pillow becomes compressed moderately when it is inserted into the envelope.

8. A rebuilt pillow made according to the method recited in claim 1, said rebuilt pillow comprising said existing pillow, surrounded by said envelope, with said envelope being enclosed in the second tick.

9. The rebuilt pillow as recited in claim 8, wherein said envelope has a wall thickness of at least about 1".

10. The rebuilt pillow as recited in claim 8, wherein said envelope has a wall thickness of about 1" and 1.5".

11. The rebuilt pillow as recited in claim 8, wherein said envelope has a circumferential dimension such that said existing pillow is moderately compressed within said envelope, whereby structural quality of said stuffing in said rebuilt pillow is improved over structural quality of said existing pillow by itself.

12. The rebuilt pillow as recited in claim 7, wherein:

(a) said envelope has a wall thickness of about 1" and 1.5";

(b) said envelope has a circumferential dimension such that said existing pillow is moderately compressed within said envelope, whereby structural quality of said stuffing in said rebuilt pillow is improved over structural quality of said existing pillow by itself.

13. A method of providing rebuilt pillows for an establishment having a plurality of existing pillows, each of said existing pillows comprising a tick and a stuffing enclosed within said tick, with the stuffing being of a structural quality to provide less than adequate cushioning support, said existing pillows having a predetermined overall configuration and dimensions, said method comprising:

(a) providing a plurality of envelopes, each having an overall configuration and overall dimensions corresponding to the existing pillows, said envelopes being made of a yielding cushioning material and having a wall thickness sufficient to mask irregularities in the stuffing of the existing pillows, each of said envelopes defining a cavity to receive existing pillows;

(b) providing a plurality of second ticks, having overall dimensions and configuration corresponding to the envelopes;

(c) collecting the existing pillows and inserting each of said existing pillows into the cavity of a related envelope;

(d) inserting each of the envelopes with its related existing pillow therein into related second ticks, and then closing the openings of the ticks to form the rebuilt pillows.

14. The method as recited in claim 13, wherein each of said envelopes has a wall thickness of at least 1".

15. The method as recited in claim 14, wherein each of said envelopes has a wall thickness between about 1" and 1.5".

16. The method as recited in claim 13, wherein each envelope is provided by first providing a generally rectangular sheet of a cushioning material having a first width dimension corresponding to a first linear dimension along a first edge of said existing pillow, and a length dimension corresponding to a circumferential dimension along a circumference of said existing pillow, which circumference lies in a plane generally perpendicular to said length dimension of the existing pillow, then folding the sheet in half and sewing it along two seams to leave an opening, after which the existing pillow can be inserted into the cavity of the envelope.

17. The method as recited in claim 13, wherein each existing pillow has a circumference dimension along a circumference line positioned in a plane perpendicular to a lengthwise dimension of said existing pillow, with said existing pillow being in an uncompressed condition, and each envelope having an interior circumference dimension moderately less than the circumference of its related existing pillow, whereby each existing pillow becomes compressed moderately when it is inserted into its related envelope.

* * * * *